US005735700A

United States Patent [19]

Hohorst

[11] Patent Number: 5,735,700

[45] Date of Patent: Apr. 7, 1998

[54] MULTIPOLE ELECTRICAL PLUG CONNECTOR

[75] Inventor: Wolfgang Hohorst, Minden, Germany

[73] Assignee: WAGO Verwaltungsgesellschaft mbH, Minden, Germany

[21] Appl. No.: 600,762

[22] Filed: Feb. 13, 1996

[30] Foreign Application Priority Data

Feb. 15, 1995 [DE] Germany ..... 195 06 862.9

[51] Int. Cl.[6] ..... H01R 4/66

[52] U.S. Cl. ..... 439/98; 439/716

[58] Field of Search ..... 439/98, 99, 94, 439/108, 716

[56] References Cited

FOREIGN PATENT DOCUMENTS 521284 1/1993 European Pat. Off. ..... 439/716

*Primary Examiner*—Gary F. Paumen
*Attorney, Agent, or Firm*—Salter & Michaelson

[57] ABSTRACT

The invention concerns a multipole plug connector and it is proposed to provide both plug-connector halves, in addition to the individual conductor throughput connections, with a shield-conductor throughput connection that can be plugged in, which extends from a shield-conductor connection piece of one plug-connector half up to the cable connection-strain relief part of the second plug-connector half.

3 Claims, 2 Drawing Sheets

MULTIPOLE ELECTRICAL PLUG CONNECTOR

BACKGROUND AND SUMMARY OF THE INVENTION

The invention concerns a multipole plug connector with a first plug-connector half, which preferably is arranged in a rigid position on an assembly rail in a housing wall, on a device or the like, and a second plug-connector half, which can be moved, i.e., plugged in and withdrawn, and has a strain relief in the form of a cable connection for fastening a multiwire cable wired with this plug-connector half.

Such plug connectors are known and are frequently used also for shielded lines, whether in a design of individually shielded single lines or lines that are shielded in groups, such as, e.g., multiwire cables with an outer shield, which will prevent reflected radiation or interference from disruptive signals.

Insofar as shielded lines with plug connectors are wired in practice, it is known to fan out the incoming and outgoing sheath and to cable the into sheath conductors for interconnecting the shielding, which one connects either to one of the single-conductor passage connections of the plug connector that are present or which one joins separately and independently from the plug connector directly to one another and/or which one connects further to the consumer (device), and/or which one distributes on a sheath piece common to several shielded lines.

These very different methods for distributing and/or interconnecting the shields prevents the necessary monitoring of wirings in connection cabinets, control boards, or the like, and also for wirings in equipment and devices.

The object of the invention is to propose a more practical manipulation for interconnecting the shields in combination with a multipole plug connector, which will be very visible, and correspondingly, the number of possible error sources in the wirings will be clearly reduced.

This object is resolved according to the invention in that the first plug-connector half, in addition to the individual conductor connections, has a connection piece for connecting a shield conductor, which is joined by means of a shield-conductor busbar, which is arranged in the insulation-material housing of the first plug-connector half, with a contact piece of the first plug-connector half, which contacts a counter-contact piece of the second plug-connector half when the two plug-connector halves are plugged together, and that the counter-contact piece is electrically connected with the cable connection of the strain relief of the second plug-connector half, whereby the cable connection contacts the shield sleeve of a shielded cable attached there.

The shield connection piece of the first plug-connector half may be, e.g., a solder connection or a flat plug connection, which projects from the insulation-material housing of the plug-connection half and correspondingly is well visible to the wiring technician and can be easily manipulated by the technician.

In the case of the second plug-connector half, which is to be wired with a shielded multiwire cable, the wiring technician only needs to attach the cable with the shield laid bare outwardly into the cable connection-strain relief, in order to assure the interconnection of the shielding.

All other through-contacts within the plug connector according to the invention are produced automatically when plugging togeher the two halve of the plug connector.

The cable connection-strain relief that contacts the shield of the cable may be mounted on an assembly plate of insulating material, which is attached to the second plug-connector half, e.g., it is injected or engaged with the latter. The electrical connection between the counter-contact piece and the cable connection may be given by a wire conductor or a shield-conductor busbar.

If, according to an appropriate form of embodiment of the invention, the shield-conductor busbar is constructed sufficiently stably, then it may be utilized without an insulation-material mounting plate as a carrier for the cable connection-strain relief. In such a case, it is very simple to plug in the shield conductor busbar with the cable connection-strain relief already present on the head end of the busbar into the insulation-material housing of the second half of the plug connector or to lock this with the latter.

In multipole plug connectors, the shield-conductor throughput connection, according to the instructions of the invention, may be present and assigned to each individual pole, for example, for the case that individually shielded single lines are wired with the plug connector. This, however, is the exceptional case. In practice, usually moveable plug connector halves, i.e., halves that can be plugged in and withdrawn, are wired with a cable with a single outer shielding. For such a case of application, it is sufficient to provide a shield-conductor connection for each half of the plug connector.

In order to be able to manufacture cost-favorable plug connectors, particularly for this latter case, according to the invention, a particularly advantageous form of embodiment of the invention provides that the two halves of the plug connector are constructed in modular form from single-pole individual terminals, which lie next to one another in a type of serial terminal or terminals that can be made into a disk-shaped terminal block and thus form a terminal block corresponding to the multipole nature [number of poles] of the plug-connector halves and that each time only a single individual terminal of a terminal block has the shield-conductor throughput connection according to the instructions of the invention.

BRIEF DESCRIPTION OF THE DRAWINGS

An example of embodiment of the invention will be more closely described in the following and is based on the drawing. Here.

DETAILED DESCRIPTION OF THE PREFERRED EMBODIMENT

Figure 1:
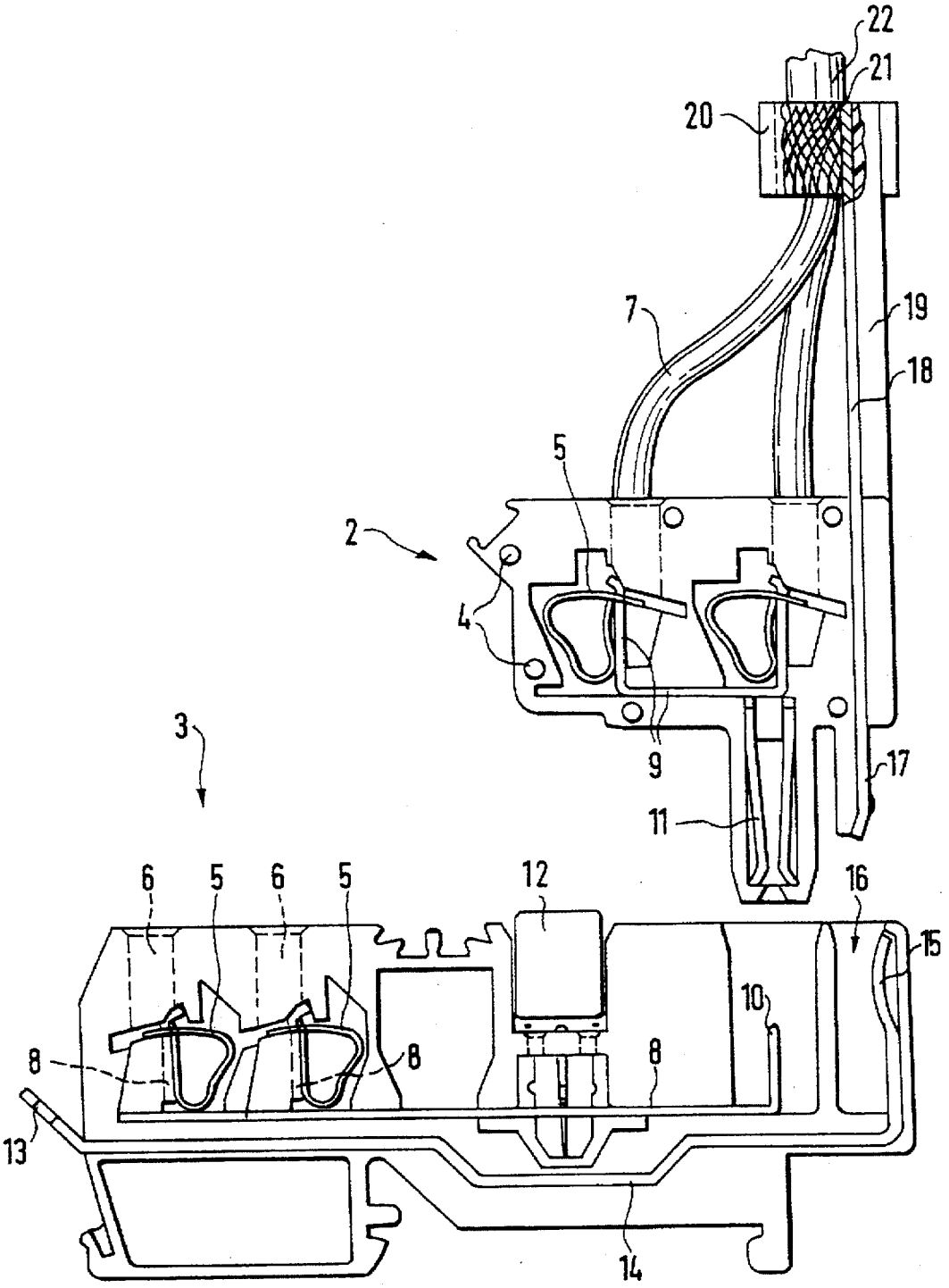
FIG. 1 shows in a simplified representation the side view of a plug connector according to the invention.
Figure 3:
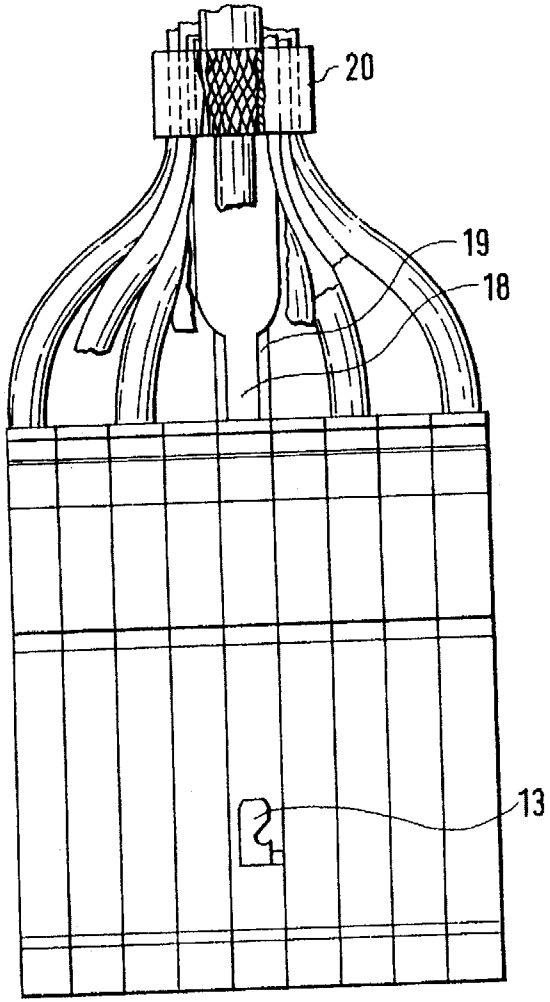
FIG. 3 shows a front view of the plug connector illustrated in FIG. 2.
Figure 2:
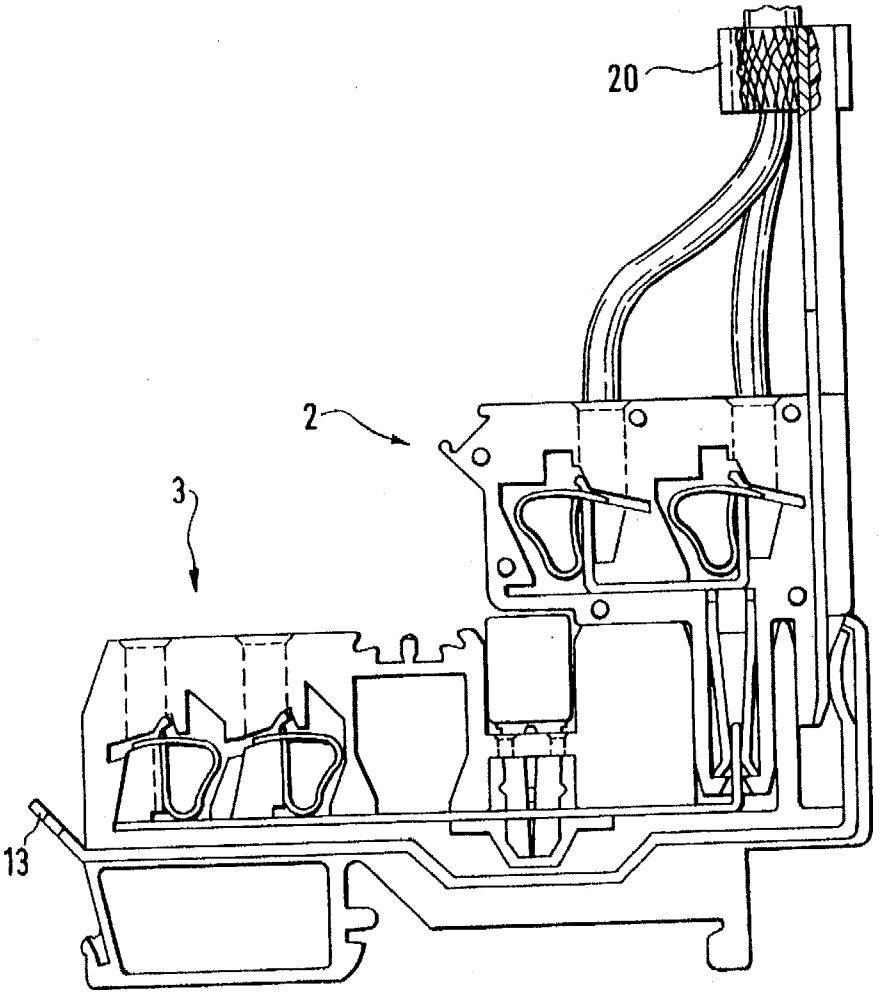
FIGS. 2 shows a representation of the side view of the plug connector in an assembled configuration.

A modular constructed plug connector is shown, i.e., both halves 2 and 3 of the plug connector consist of disk-shaped individual terminals lying next to one another, which are serial pole terminals in the case of plug-connector half 2, and these are locked to form a terminal block corresponding to the desired number of poles of the plug-connector half by means of the locking pin 4, and are engaged in the case of plug-connector half 3 as serial terminals on an assembly rail (not shown), to form a terminal block corresponding to the desired number of poles of the plug-connector half.

As is known, both halves of the plug connector possess double connections for each pole terminal for the connection of the individual lines. As is known, each connection consists of a terminal spring 5 by means of which an electrical conductor 7 introduced into the opening 6 for inserting the conductor is clamped against busbar 8 or 9. The busbars join the two terminal sites to each other as well as to plug part 10 of plug-connector half 3 or bushing part 11 of plug-connector half 2. For possible cross-bridging between the individual pole terminals, busbar 8 has plug slots, into which a U-shaped cross-bridge 12 can be plugged in. This is also known.

The shield-conductor passage connection, which has connection piece 13 in the form of a solder connection or in the form of a flat plug connection in the case of plug-connector half 3, is novel. This shield-conductor connection piece 13 is joined by means of a shield-conductor busbar 14 with a contact piece 15, which is positioned in a back plug pocket 16 of plug-connector half 3.

The lower end 17 of the shield-conductor busbar 18 arranged in plug-connector half 2 is engaged in this plug pocket 16, if the two plug connector halves 2 and 3 are plugged together. This lower end 17 engages the contact piece 15 as it is disposed in lower plug-connector half 3.

Shield-conductor busbar 18 of upper plug-connector half 2 is stabilized in the case of the example of embodiment that is shown by a back insulation-material plate 19, which has on its upper head end a metal cable connection 20, which surrounds the shield sleeve 21 of cable 22 lying bare outwardly. Thus, cable connection 20 is joined electrically with shield sleeve 21 of cable 22, and it is also joined electrically with shield-conductor busbar 18, so that according to the instructions of the invention, after plugging together the two halves 2 and 3 of the plug connector, there is an electrical connection that passes through between shield-conductor connection piece 13 of lower plug-connector half 3 and cable connection 20 of upper plug connector 2 or shielded sleeve 21 of cable 22 that is fastened there.

Cable connection 20 has also the function of a strain relief for cable 22 attached there, in combination with back stabilizing plate 19.

What is claimed is:

1. A multipole plug connector comprising a first plug-connector half which is arranged in a rigid manner on an assembly rail in a housing wall of a device, a second plug-connector half which can be plugged in and withdrawn from the first plug-connector half, said second plug-connector half having multiwire cable wired thereto and a cable connection which functions as a strain relief, characterized by the first plug-connector half having a connection piece for connecting a shield conductor, said shield conductor connection piece being connected to a contact piece of the first plug-connector half by means of a first shield conductor busbar which is arranged in the housing wall of the first plug-connector half, said contact piece contacting a counter-contact piece of said second plug-connector half when the two halves of the plug connector are plugged together, said counter-contact piece being connected electrically with the cable connection of the second plug-connector half, and said cable connection contacting a shield sleeve of a shielded cable fastened thereto.

2. The plug connector according to claim 1, further characterized in that the connection between counter-contact piece and cable connection is produced by a stable second shield-conductor busbar which is attached to the insulation-material housing of the second plug-connector half, said second shield-conductor busbar bearing the cable connection strain relief.

3. The plug connector according to claim 1, further characterized in that both plug-connector halves are constructed modularly from single-pole individual terminals which lie next to one another in a type of serial terminal or terminals that can be arranged in a disk shape and form a terminal block corresponding to the multipole nature of the plug-connector halves, one individual terminal of the terminal block having a shield-conductor throughput connection.

* * * * *